United States Patent [19]

Liou

[11] Patent Number: 4,644,687

[45] Date of Patent: Feb. 24, 1987

[54] DOOR WITH A SHUTTER DEVICE

[76] Inventor: Shu L. Liou, 2Fl., No. 33, Lane 52, Szu Wei Road, Taipei, Taiwan

[21] Appl. No.: 757,168

[22] Filed: Jul. 22, 1985

Related U.S. Application Data

[63] Continuation-in-part of Ser. No. 570,095, Jan. 12, 1984, abandoned.

[51] Int. Cl.[4] ..... E06B 7/02

[52] U.S. Cl. ..... 49/38; 49/171

[58] Field of Search ..... 49/38, 171

[56] References Cited

U.S. PATENT DOCUMENTS

| | | | |
|---|---|---|---|
| 374,105 | 11/1887 | Wilson | 49/38 |
| 1,613,913 | 1/1927 | Snyder | 49/38 X |
| 3,946,523 | 3/1976 | Hebda | 49/38 |

*Primary Examiner*—Kenneth Downey

[57] ABSTRACT

A door with shutter device, having a door panel provided with a plurality of through holes, and a shutter panel moveably disposed to overlap the door panel, the shutter panel having a plurality of through holes of the same size, configuration and arrangement as the through holes of the door panel. The shutter panel is urged by a spring to remain at a closed position where the through holes of the shutter panel are out of alignment with the through holes of the door panel. Operating means is provided to selectively move the shutter panel from the closed position to an open position where the through holes of the shutter panel are aligned with the through holes of the door panel so that one can see the object or person at the otherside of the door without opening the door, through the through holes.

7 Claims, 20 Drawing Figures

DOOR WITH A SHUTTER DEVICE

BACKGROUND OF THE INVENTION

This application is a continuation-in-part application of U.S. patent application Ser. No. 570,095 filed on Jan. 12, 1984, which is now abandoned.

Various means of precaution against strangers are available for those who are hesitant to allow entry to a person at the entrance before knowing the identity of the person or the intent of the visitor. Among these means of precaution against strangers are door chains, fish eye lenses and TV monitors. However, door chains and fish eye lenses require one's presence at the door, and TV monitors require a relatively sophisticated and costly set up.

In view of the aforesaid problems with conventional devices for precaution against strangers, this invention offers a door with a shutter device that can be operated either directly by hand, or electrically from a distance, to allow one to see the visitor without opening the door.

BRIEF DESCRIPTION OF THE INVENTION

This invention offers a door with a shutter device, which comprises a door having two door panels provided with a plurality of through holes; a shutter panel movably disposed between the two door panels, the shutter panel being provided with a plurality of through holes to correspond with the through holes of the two door panels; and an operating device adapted to selectively move the shutter panel from one position where the through holes of the shutter panel are out of alignment with the through holes of the two door panels, to another position where the through holes of the shutter panel are aligned with the through holes of the two door panels, thus enabling one to see through the door the object or person on the opposite side of the door. The shutter panel is normally urged by a spring member to remain in a "CLOSED" position. The operating device includes a pull-rod operatively arranged for manually moving the shutter panel, and an electric circuit having solenoids and switches for moving the shutter panel electrically from a distance.

In a preferred embodiment the door is further provided with a wicket gate to allow an article to be delivered therethrough without opening the door.

DETAILED DESCRIPTION OF THE INVENTION

Figure 1:
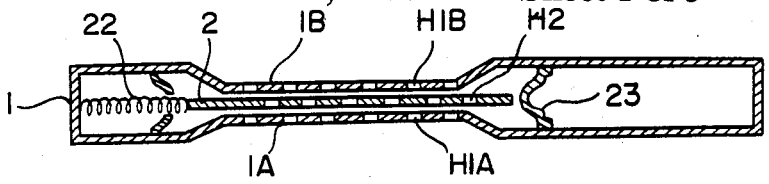
FIG. 1 is a cross-sectional top view of a first embodiment of the door with a shutter device of this invention, showing the arrangement of the door panels and the shutter panel.

In FIG. 1 there is shown a first embodiment of the door with shutter device of this invention which comprises a door 1 having a front door panel 1A and rear door panel 1B, and a shutter panel 2 movably disposed between front and rear door panels 1A and 1B. Front door panel 1A is provided with a plurality of through holes H1A, and rear door panel 1B is also provided with a plurality of through holes H1B identical in shape and corresponding in size, configuration, and location with through holes H1A of front door panel 1A. Shutter panel 2 is provided with a plurality of through holes H2 identical in shape and corresponding in size, configuration, and location with through holes H1A and H1B of front and rear door panels 1A and 1B.

Figure 2:
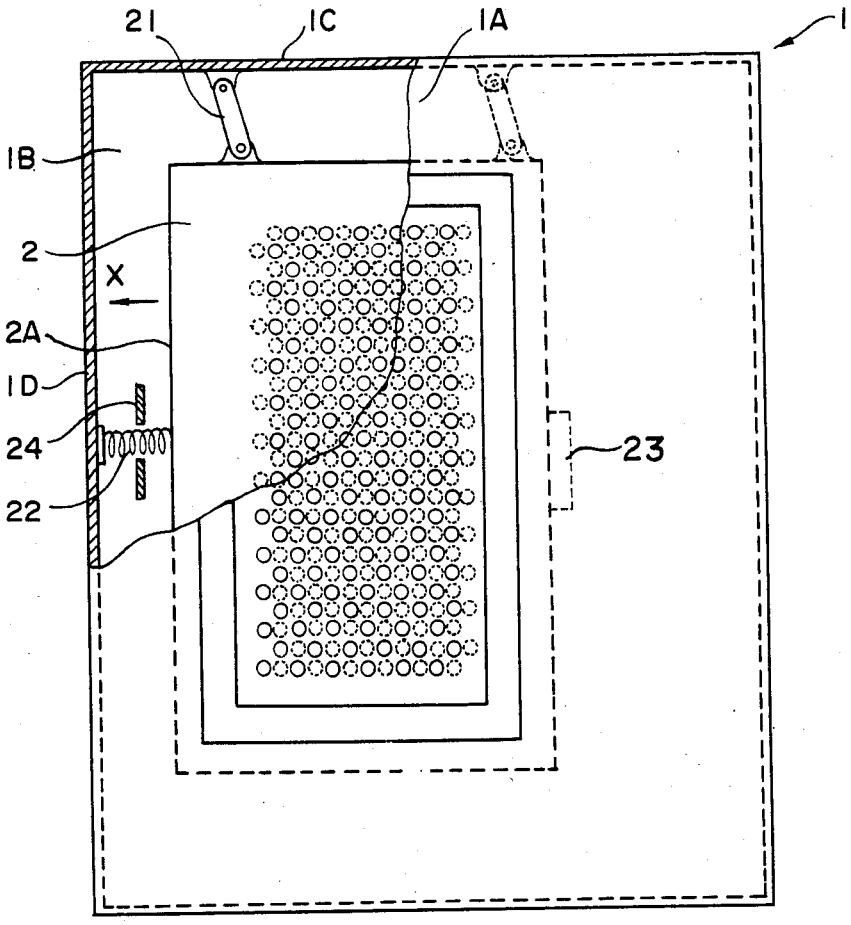
FIG. 2 is a front view of the first embodiment of the door with a shutter device of this invention, with the front door panel partially in section, and the operating device omitted from the drawing.
Figure 3:
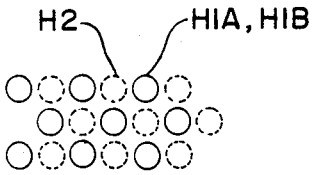
FIG. 3 is a schematic drawing showing the arrangement of the through holes when the shutter panel is in the "CLOSED" position.

As shown in FIG. 2, shutter panel 2 is movably suspended to an upper part 1C of door 1 with links 21, and urged from one side by spring member 22 disposed between a side edge 2A of shutter panel 2 and a side part 1D of door 1. A stopper 23 is provided within door 1 at the opposite side of shutter panel 2 so as to stop shutter panel 2 at a "CLOSED" position where through holes H2 (FIG. 1) of shutter panel 2 are out of alignment with through holes H1A and H1B of front and rear door panel 1A and 1B, as shown in FIG. 3. Through holes H1A, H1B and H2 are so arranged that there is sufficient space between each two neighboring through holes H1A and H1B of a door panel 1A or 1B to cover through holes H2 of the shutter panel when shutter panel 2 is at the "CLOSED" position, so that each through hole is "CLOSED" at this position. Through holes H1A, H1B and H2 are also so arranged that shutter panel 2, front door panel 1A and rear door panel 1B respectively constitute a screen through which an object on one side of the screen can be seen and identified by one from a distance on the opposite side of the screen.

Figure 4:
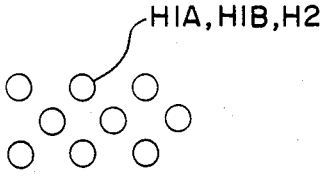
FIG. 4 is a schematic drawing showing the arrangement of the through holes when the shutter panel is in the "OPEN" position.

Shutter panel 2 can be moved in direction X as shown in FIG. 2 to an "OPEN" position where through holes H2 of shutter panel 2 are moved to come into alignment with through holes H1A, H1B of front and rear door panel 1A and 1B, as shown in FIG. 4. A stopper 24 (FIG. 2) is provided to stop shutter panel 2 in the "OPEN" position. With shutter panel 2 in this "OPEN" position one from a distance can see the object or person on the opposite side of door 1 through the aligned through holes H2, H1A and H1B.

Figure 5:
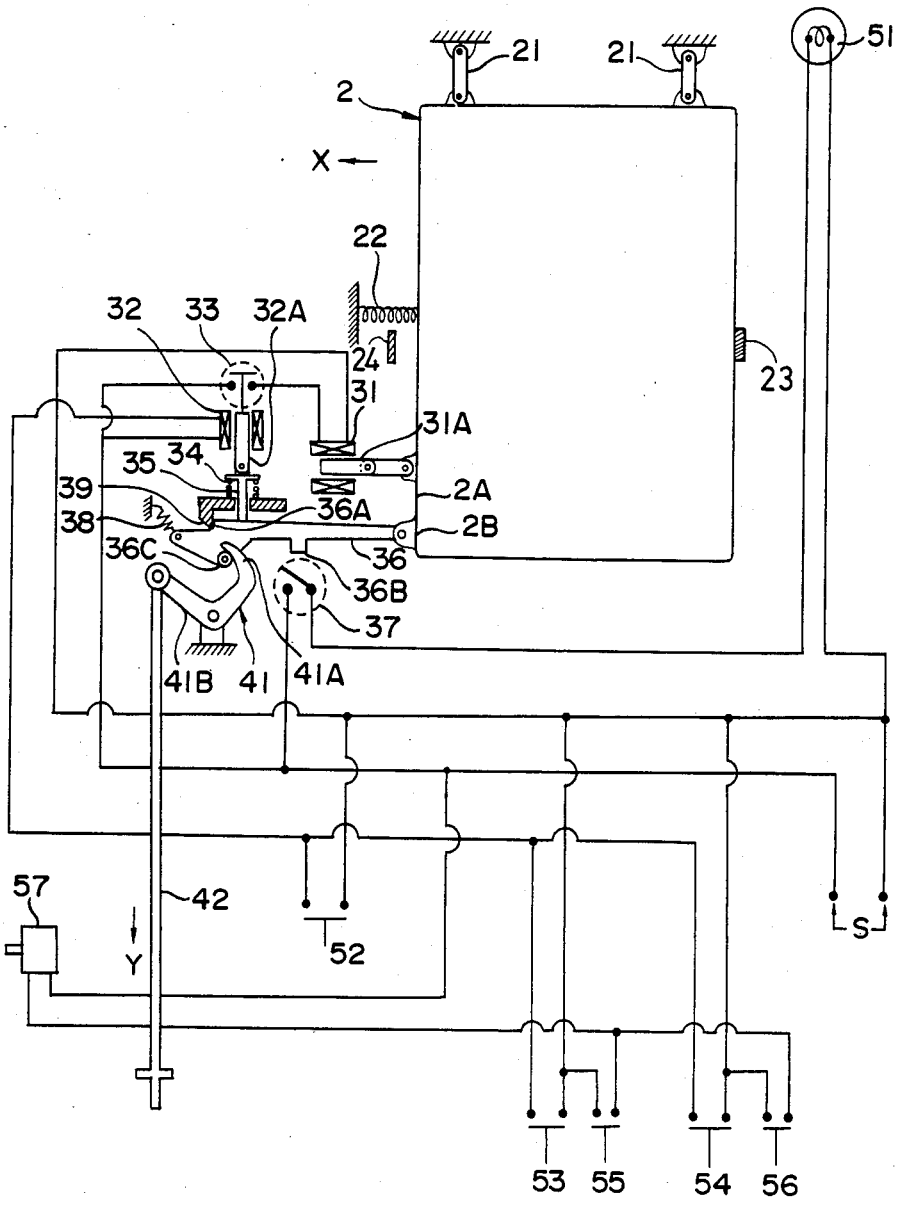
FIG. 5 is a schematic view of the shutter panel showing the arrangement of the operating device.

The door with shutter device of this invention is further provided with an operating device, as schematically illustrated in FIG. 5. The operating device includes a pull rod 42 to be pulled by and to move shutter panel 2 manually, and an electric circuit operable by switches 52, 53 and 54, to move shutter panel 2 electrically, to be described below.

As shown in FIG. 5, shutter panel 2 is provided with spring 22 which urges shutter panel 2 against stopper 23, so as to keep shutter panel 2 in the "CLOSED" position. An operating lever 36 is provided to cooperate with pull rod 42. Operating lever 36 has one end pivotally connected to side part 2A of shutter panel 2 with hinge 2B, and another end extending in the same direction in which shutter panel 2 is moved to the "OPEN" position and resiliently suspended to a structural part of the door with spring 38. Operating lever 36 is provided with a locking means which includes shoulder 36A to engage dog member 39, which is fixedly provided onto the structural part of the door to block the movement of operating lever 36 towards the left, along the direction in which shutter panel 2 is moved to the "OPEN" position; a projection 36B to correspond with switch 37, and a stud 36C. Pull rod 42 is operatively engaged with operating lever 36 by a releasing means which includes a bell crank 41 having a hook 41A on one end and an arm 41B on another end and being pivotally disposed between operating lever 36 and pull rod 42, with arm 41B pivotally connected to pull rod 42 and hook 41A engaging stud 36C, in such a manner that when pull rod 42 is pulled in Y direction, hook 41A is rotated to first depress stud 36C downwards causing operating lever 36 to pivot downwards with respect to hinge 2B; and second push stud 36C to move toward the left, or in X direction as pull rod 42 is pulled further in Y direction, so as to pull shutter panel 2 to move in X direction. The downwards pivoting movement of operating lever 36 causes shoulder 36A to disengage from dog member 39 thus releasing the "blocking" of the movement of operating lever 36, and at the same time causes projection 36B to engage with switch 37 to be explained later.

The electric circuit includes a first solenoid 31 having a plunger 31A connected to side part 2A of shutter panel 2, a second solenoid 32 having a plunger 32A with one end connected to tongue member 35 which extends through the body of dog member 39 and abuts the upper side of operating lever 36, and another end operatively connected to switch 33. First solenoid 31 is electrically connected to a power source S, through switch 33 which is normally open. When switch 33 is closed to energize first solenoid 31, plunger 31A is actuated to pull shutter panel 2 in X direction. Second solenoid 32 is electrically connected to power source S through parallel switches 52, 53 and 54. When one of switches 52, 53 and 54 is closed, second solenoid 32 is energized to activate plunger 32A in such a manner that tongue member 35 extends to push operating lever 36 to pivote downwards. Shoulder 36A of operating lever 36 is thus caused to disengage from tongue member 35, and as soon as shoulder 36A is disengaged from dog member 39, switch 33 is closed to energize first solenoid 31. A spring 34 is provided to urge plunger 32A to return when solenoid 32A is de-energized, so as to keep switch 33 open and tongue member 35 at a retracted position.

Switch 37, which is normally open, is closed when operating lever 36 is caused to pivot downwards, so as to light a lamp 51 for lighting the object at the entrance. In FIG. 5, 57 is an electric door lock which can be opened by turning on switch 55 or 56.

By releasing pull rod 42 after pull rod 42 has been pulled to move shutter panel 2 in X direction, shutter panel 2 is moved back to the original position by the pressure of spring member 22, and operating lever 36 is also moved back to the original position, with its free end pulled upwards to cause shoulder 36A to engage with dog member 39.

By releasing the switch 52, 53 or 54 after it has been depressed to close and to move shutter panel 2 in X direction, shutter panel 2 and operating lever 36 return in the same way as operated with pull rod 42 manually.

Switch 52 may be conveniently mounted at the door side while switches 53 and 54 may be installed at other places to facilitate a remote operation. Switches 55 and 56 for electric door lock 57 may be installed at the same place as switches 53 and 54.

Figure 6:
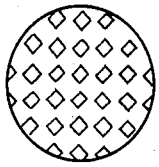
FIGS. 6–12 are examples of alternate shapes of the through holes that might be employed in the door panels and shutter panel.
Figure 7:
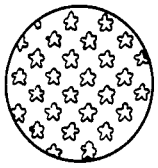
Figure 8:
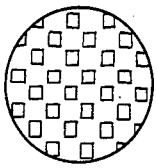
Figure 9:
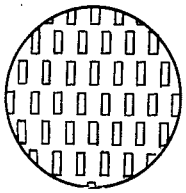
Figure 10:
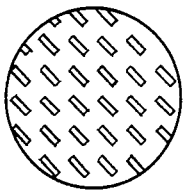
Figure 12:
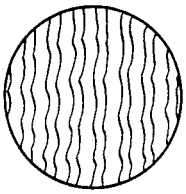
Figure 11:
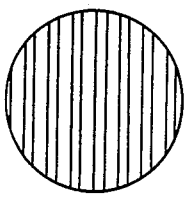

While round holes have been illustrated for through holes H1A, H1B and H2 of the front and rear door panels 1A and 1B and shutter panel 2, holes or slots of other shapes such as diamond shaped holes as shown in FIG. 6; flower shaped holes as shown in FIG. 7; square holes as shown in FIG. 8; vertical rectangular holes as shown in FIG. 9; slanted rectangular holes as shown in FIG. 10; straight vertical slots as shown in FIG. 11; and wavy vertical slots as shown in FIG. 12, are equally applicable to a door with the shutter device of this invention.

Figure 13:
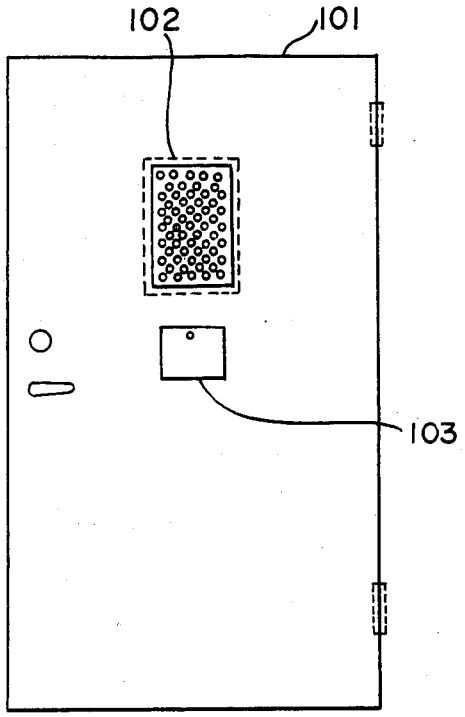
FIG. 13 is a schematic front view of a second embodiment of the door with a shutter device of this invention having a hinged wicket gate.
Figure 14:
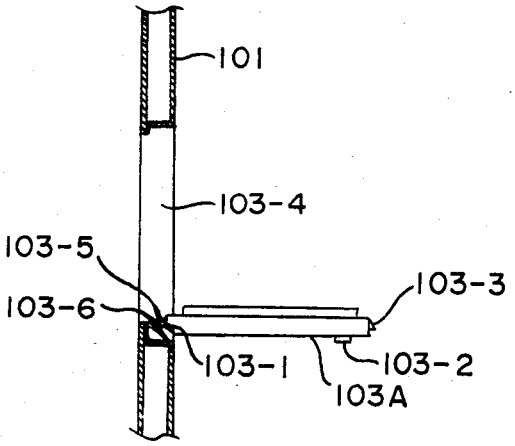
FIG. 14 is a cross sectional view of the hinged wicket gate employed in the second embodiment of the door of FIG. 13.

In FIG. 13 there is shown a second embodiment of the door with a shutter device of this invention, the door having a shutter panel 102 and an operating device (not shown) as described in the previous embodiment, and a hinged wicket gate 103 beneath shutter panel 102. Hinged wicket gate 103 consists of a generally rectangular gate member 103A having a lower edge pivotally mounted with hinges 103-1 onto the lower edge of an opening 103-4 formed in door 101, so that gate member 103A can be swung up to close, or swung down to open opening 103-4. Gate member 103A has a latch 103-3 operable with knob 103-2 so that when gate member 103A is swung up latch 103-3 engages with the upper edge of opening 103-4 to hold gate member 103A in place. A dog 103-5 is provided on the lower edge of the gate member 103A to abut stopper 103-6 provided on the lower part of opening 103-4 to hold gate member 103A at a generally horizontal position when gate member 103A is swung down. Wicket gate 103 enables the occupant of the room to receive articles to be passed through opening 103-4 without opening door 101, so as to prevent visitors from gaining access to the occupant of the room.

Figure 15:
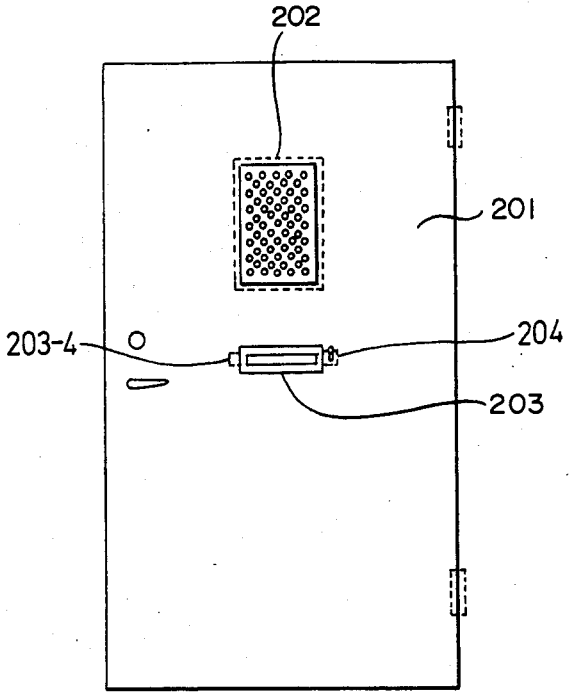
FIG. 15 is a schematic front view of a third embodiment of the door with a shutter device of this invention having a rotary wicket gate.
Figure 16:
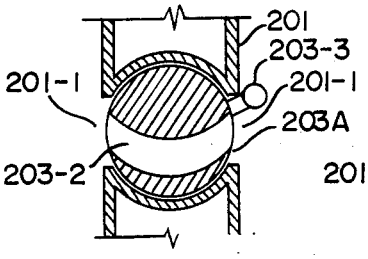
FIGS. 16 and 17 are cross sectional views of the rotary wicket gate employed in the door of FIG. 15, respectively showing the rotary gate member in an opened position and in a closed position.
Figure 17:
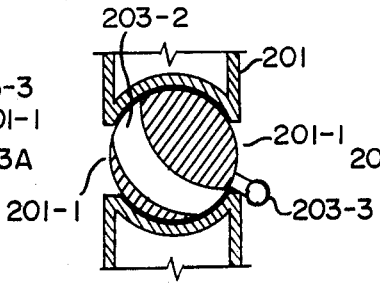
Figure 20:
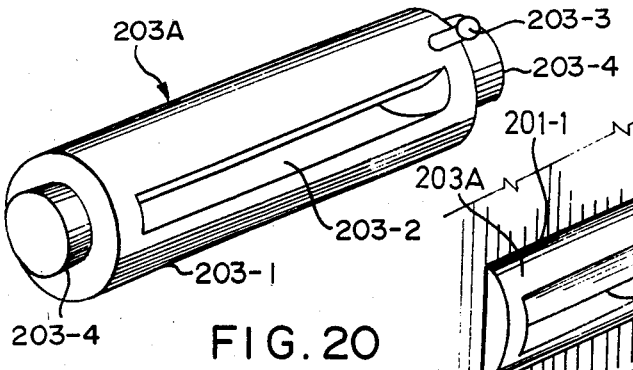
FIG. 20 is a perspective view of the rotary wicket gate of the door of FIG. 15.

FIG. 15 shows a third embodiment of the door with a shutter device of this invention, which is provided with a shutter panel 202 and an operating device (not shown) as described in the first embodiment, and rotary wicket gate 203 beneath shutter panel 202. As shown in FIG. 16, 17 and 20, rotary wicket gate 203 consists of a rotary gate member 203A having a generally cylindrical body 203-1 and a longitudinal slot 203-2 which is arcuated in a radial direction and open to communicate with two opposite sides of cylindrical body 203-1. Rotary gate member 203A is further provided with a journal 203-4 extending from each end of cylindrical body 203-1 and is rotatably mounted in an opening 201-1 formed in door 202, as shown in FIG. 15, in such a manner that rotary gate member 203A can be rotated to one position (FIG. 16) to allow longitudinal slot 203-2 of rotary gate member 203A to communicate with opening 201-1 of door 201 so as to allow relatively thin articles such as letters to be passed through longitudinal slot 203-2 of rotary gate member 203A, and also to another position (FIG. 17) to close opening 201-1 of door 201. An operating handle 203-3 is provided on rotary gate member 203A to facilitate the rotation of rotary gate member 203A, as shown in FIGS. 18, 19 and 20.

Figure 18:
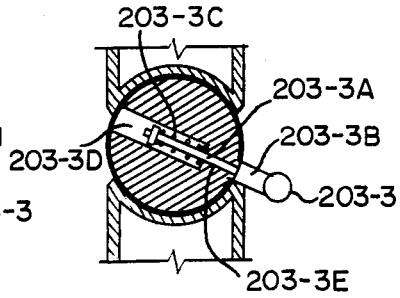
FIG. 18 is a cross sectional view of the rotary gate member, showing the arrangement of the handle.
Figure 19:
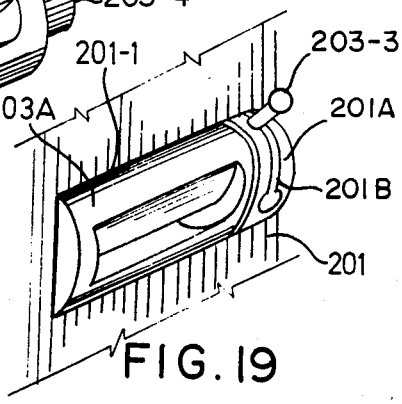
FIG. 19 is a perspective view of the rotary gate member employed in the wicket gate shown in FIGS. 15, 16 and 17.

Operating handle 203-3 preferably consists of a handle body 203-3B and a stem 203-3A extending from handle body 203-3B, stem 203-3A having a diameter smaller than that of handle body 203-3B, as shown in FIG. 18. Stem 203-3A is inserted into a hole 203-3E provided in rotary gate member 203A, hole 203-3E communicating with an enlarged hole 203-3D wherein a spring 203-3C is disposed to urge stem 203-3A in such a fashion as to resiliently pull the handle 203-3 toward rotary gate member 203A. As shown in FIG. 19, a cover plate 201A having an arcuated slot 201B is provided at one end of opening 201-1 on the inner side of door 201, to cover one end of rotary gate member 203A having operating handle 203-3. Each end of arcuated slot 201B has an enlarged opening to allow handle 203-3 to extend there through. Arcuated slot 201B has a width that allows stem 203-3A to move therealong but does not allow handle body 203-3B to pass. To operate rotary gate member 203A, one must first pull handle 203-3 outwards to move handle body 203-3B out of opening at the end of slot 201B, than the rotary gate member 203A can be rotated by moving handle 203-3 along slot 201B with handle 203-3 being pulled outwards by hand.

What is claimed is:

1. A door construction, comprising:

a first door panel a portion thereof having a plurality of openings, a shutter panel suspended from an upper part of said door by links and moveably disposed to overlap said door panel, said shutter panel having a plurality of openings of the same size, configuration and location as the openings of said door panel, said openings being arranged in a screen-like formation to enable one from a distance to see through said openings and identify an object on the opposite side of said shutter panel without opening said door, an operating device for selectively moving said shutter panel between a first position where said openings of said shutter panel are out of alignment with said openings of said door panel, and a second position where said openings of said shutter panel are aligned with said openings of said door panel, said shutter panel being normally urged into said first position by a spring member; said operating device having a locking means for locking said shutter panel in said first position, and a releasing means for releasing said shutter panel from being locked in said first position when said operating device is operated to move said shutter panel from said first position to said second position and a wicket gate in said door panel below said shutter panel adapted to be selectively openable for the passage of articles.

2. A door construction as recited in claim 1, which further comprises a second door panel having a plurality of openings identical to and corresponding with said openings of first door panel, and said shutter panel being disposed between said first and second door panels.

3. A door construction as recited in claim 1, wherein said shutter panel is provided with a spring member which urges said shutter panel to remain at said first position, and said operating means comprises:

an operating rod having a first end connected to said shutter panel and a second end resiliently retained with respect to said door panels;

a pull rod operatively connected with said operating rod by said releasing means;

and said locking means comprises a shoulder formed on said operating rod, and a dog member with which said shoulder of said operating rod engages when said shutter panel is in said first position, said dog member being fixed onto a door structure.

4. A door construction as recited in claim 3, wherein said releasing means comprises a bell crank pivotally mounted onto a door structure and having one arm pivotally connected to said pull rod and another arm slidably engaged with a stud formed on said operating lever.

5. A door construction as recited in claim 4, which further includes an electric circuit, comprising:

a first solenoid adapted to cause said shoulder to disengage from said dog member when said solenoid is energized;

a first switch adapted to be closed when said shoulder is disengaged from said dog member;

a second solenlid adapted to cause said shutter panel to move from said first position to said second position when said second solenoid is energized, said second solenoid being electrically connected to a power source through said first switch; and a plurality of switches in parallel connection for electrically connecting said first solenoid to the power source.

6. A door construction as in claim 1 wherein said wicket gate comprises a rectangular gate member pivotally hinged to the lower edge of an opening formed in said door, said gate member having latch means engageable with the upper edge of said opening and a dog member abuttable with a stopper maintaining said gate member in a horizontal position when open.

7. A door construction as recited in claim 1 wherein said wicket gate comprises a rotary gate member having a generally cylindrical body in which is disposed a radially arcuate longitudinal slot, journal means extending from each end of said body and an operating means, said rotary gate member being rotatably mounted by said journal means in an opening formed in said door.

* * * * *